US010820130B2

(12) United States Patent
Sullivan et al.

(10) Patent No.: US 10,820,130 B2
(45) Date of Patent: Oct. 27, 2020

(54) METHOD OF FORMING A SPEAKER HOUSING

(71) Applicant: Bose Corporation, Framingham, MA (US)

(72) Inventors: Donna M. Sullivan, Millbury, MA (US); Gregory F. Shannon, Bellingham, MA (US); Jason R. Pupecki, Worcester, MA (US)

(73) Assignee: BOSE CORPORATION, Framingham, MA (US)

( * ) Notice: Subject to any disclaimer, the term of this patent is extended or adjusted under 35 U.S.C. 154(b) by 255 days.

(21) Appl. No.: 15/707,136

(22) Filed: Sep. 18, 2017

(65) Prior Publication Data

US 2019/0090076 A1 Mar. 21, 2019

(51) Int. Cl.

| | |
|---|---|
| ***H01R 31/00*** | (2006.01) |
| ***H04R 31/00*** | (2006.01) |
| ***B21C 23/08*** | (2006.01) |
| ***B21D 28/28*** | (2006.01) |
| ***C25D 11/16*** | (2006.01) |

(52) U.S. Cl.

CPC ..... *H04R 31/00* (2013.01); *B21C 23/085* (2013.01); *B21D 28/28* (2013.01); *C25D 11/16* (2013.01)

(58) Field of Classification Search

CPC ..... B21C 23/085; H04R 31/00; C25D 11/16; B21D 28/28

See application file for complete search history.

(56) References Cited

U.S. PATENT DOCUMENTS

| | | | | |
|---|---|---|---|---|
| 3,759,203 | A | 9/1973 | Frankenberg | |
| 4,297,777 | A * | 11/1981 | Kucza | B22F 3/20 419/5 |
| 5,171,223 | A * | 12/1992 | Herzberg | A61B 1/00085 604/104 |
| 7,827,683 | B2 * | 11/2010 | Weiss | B21C 23/20 29/557 |
| 2009/0102234 | A1 | 4/2009 | Heatherington et al. | |
| 2017/0248097 | A1 * | 8/2017 | Maki | B21C 23/085 |
| 2017/0273356 | A1 * | 9/2017 | Sebastian | A24F 47/008 |

FOREIGN PATENT DOCUMENTS

| | | | |
|---|---|---|---|
| DE | 2363629 | A1 | 6/1975 |
| DE | 102007024357 | B3 | 10/2008 |
| WO | 2006113608 | A2 | 10/2006 |

OTHER PUBLICATIONS

International Search Report and Written Opinion for International Application No. PCT/US2018051304, dated Feb. 22, 2019, 11 pages.

* cited by examiner

*Primary Examiner* — Paul D Kim
(74) *Attorney, Agent, or Firm* — Hoffman Warnick LLC

(57) ABSTRACT

Various implementations include methods and related tools for forming loudspeaker housings. In some implementations, these methods and tools can be used to form a loudspeaker housing having a non-circular shape. One method includes: forming a set of perforations along a first region of a wall of a hollow cylinder of material; and deforming the wall to a non-circular shape after forming the set of perforations.

15 Claims, 10 Drawing Sheets

METHOD OF FORMING A SPEAKER HOUSING

TECHNICAL FIELD

This disclosure generally relates to manufacturing. More particularly, the disclosure relates to approaches for manufacturing speaker components and tools for performing such manufacturing processes.

BACKGROUND

In designing and manufacturing speaker systems, e.g., portable speaker systems or modular speaker components, form and function each play a significant role in the finished product. In many cases, these form factors and functional constraints are also limited by the additional constraints of manufacturing time and cost. As such, it can be difficult to design and manufacture speaker systems that meet particular form factors, function at a desired level, are producible in a desired period, and meet a budget in line with market factors.

SUMMARY

All examples and features mentioned below can be combined in any technically possible way.

Various implementations include methods and related tools for forming loudspeaker housings. In some implementations, these methods and tools can be used to form a loudspeaker housing having a non-circular shape.

In some particular aspects, a method includes: forming a set of perforations along a first region of a wall of a hollow cylinder of material; and deforming the wall to a non-circular shape after forming the set of perforations.

In other aspects, a tool includes: a set of compression members sized to accommodate a hollow cylinder of material, the set of compression members each having an elongated arcuate interface for contacting distinct portions of an outer surface of a wall of the hollow cylinder of material; and a set of elongation members sized to fit inside the hollow cylinder of material, the set of elongation members each having an arcuate interface for contacting distinct portions of an inner surface of the wall of the hollow cylinder of material, where the set of compression members and the set of elongation members are configured to compress the hollow cylinder of material in a first dimension and elongate the hollow cylinder of material in a second dimension distinct from the first dimension to form a non-circular seamless cylinder.

Implementations may include one of the following features, or any combination thereof.

In some implementations, the method can further include, prior to forming the set of perforations along the first region of the wall: extruding the hollow cylinder of material from a precursor structure; and cutting the hollow cylinder of material to a predetermined length. In certain implementations, the wall surrounds a primary axis of the hollow cylinder, and cutting to the predetermined length includes cutting the hollow cylinder of material at an angle approximately perpendicular to the primary axis. In particular cases, extruding the hollow cylinder of material from the precursor structure is performed using a hot extrusion press.

In some implementations, the method can further include reducing a thickness of the wall in the first region of the hollow cylinder, such that the set of perforations is formed in the region of reduced thickness.

In certain cases, the method can further include blasting and anodizing the wall after deforming the wall to the non-circular shape.

In particular implementations, each of the set of perforations extends entirely through the first region of the wall. In some implementations, the first region of the wall has an inner surface and an outer surface opposing the inner surface, and the set of perforations each have a primary axis approximately perpendicular to each of the outer surface and the inner surface around each perforation at the first region of the wall. In particular cases, the primary axis of each perforation deviates by less than approximately 3 degrees from perpendicular between the inner surface and the outer surface.

In various implementations, the perforations extend around at least a portion of a circumference of the wall along the first region. In some cases, the perforations extend around an entirety of the circumference of the wall along the first region.

In certain implementations, the hollow cylinder of material is seamless about a primary axis thereof.

In some cases, deforming the wall to the non-circular shape includes deforming the wall to an ellipsoidal cylindrical shape.

In particular implementations, the hollow cylinder of material includes a metal. In some cases, the metal includes aluminum.

In some implementations, the set of compression members in the tool includes two compression members for aligning opposed to one another relative to the hollow cylinder of material, and the set of elongation members includes two elongation members for aligning adjacent one another inside the hollow cylinder of material.

In certain cases, the second dimension of the hollow cylinder of material is substantially perpendicular to the first dimension.

In particular implementations, the hollow cylinder of material includes at least one recess along the inner surface of the wall, and at least one of the set of elongation members includes a mating feature for complementing the at least one recess.

In certain cases, the non-circular seamless cylinder is formed by moving the compression members toward one another to compress the hollow cylinder of material in the first dimension while substantially simultaneously moving the elongation members away from one another to elongate the hollow cylinder of material in the second dimension, and the elongated arcuate interface of the set of compression members is non-complementary with respect to the arcuate interface of the set of elongation members.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
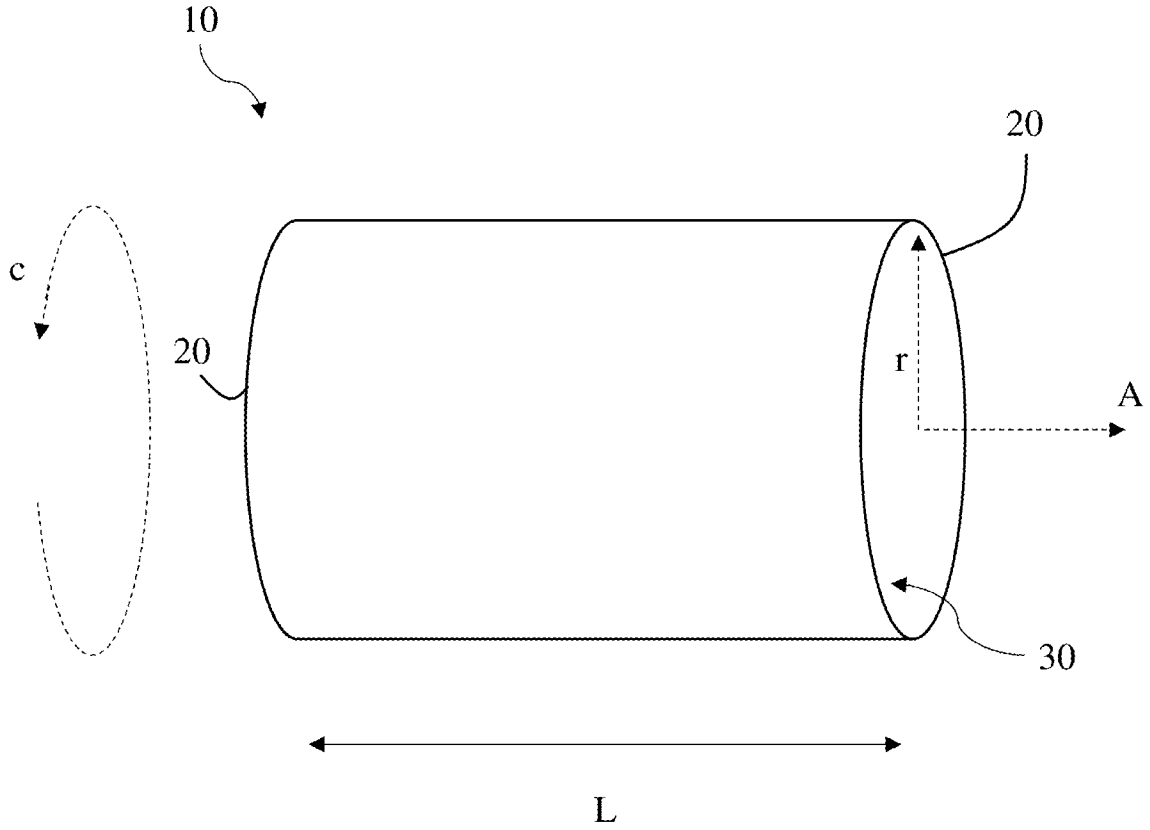
FIG. 1 shows a perspective view of a hollow cylinder formed according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a seamless, non-circular loudspeaker housing can be formed by an efficient process. For example, a non-circular shaped loudspeaker housing can be formed by a streamlined process to include an integral grille.

Commonly labeled components in the FIGURES are considered to be substantially equivalent components for the purposes of illustration, and redundant discussion of those components is omitted for clarity.

In various implementations, a method can be used to form a seamless, non-circular loudspeaker housing. In particular cases, the loudspeaker housing includes an internal grille with a plurality of perforations (or, apertures) that are approximately normal (i.e., approximately perpendicular) to the surface(s) of the housing.

FIG. 1 shows a schematic depiction of a hollow cylinder of material (also referred to as "hollow cylinder") 10. The hollow cylinder 10 can include a wall 20 at least partially defining an inner area 30. The term "inner," when referring to the inner area 30, is used merely to denote that a space is at least partially bounded by the wall 20 of hollow cylinder 10. Hollow cylinder 10 can include a metal (e.g., aluminum, or cold rolled steel), or a plastic (e.g., a thermoplastic such as wood filled polypropylene or a polycarbonate such as glass filled polycarbonate). In some cases, hollow cylinder 10 is formed of a substantially homogeneous material, such as in the case of a metal. That is, the hollow cylinder 10 can be formed from a precursor structure that is substantially homogeneous in that it includes a nearly uniform composition throughout. This "substantial" homogeneity can allow for nominal impurities. In various implementations, wall 20 can surround a primary axis (A) of the hollow cylinder 10, and define a circumference (c) of that hollow cylinder 10. As shown, hollow cylinder 10 can be formed as a circular cylinder having an approximately identical radius (r) (e.g., within margin of error) at all points along the circumference (c), as measured from a corresponding location along the primary axis (A). In various implementations, the hollow cylinder 10 is seamless about the primary axis (A), such that wall 20 is formed of a single, continuous piece of material. In these cases, the outer surface of the hollow cylinder 10 appears to be uniform around the entire circumference (c). That is, in some implementations, the hollow cylinder 10 does not include a fold, joint or other junction around the circumference (c).

Figure 2:
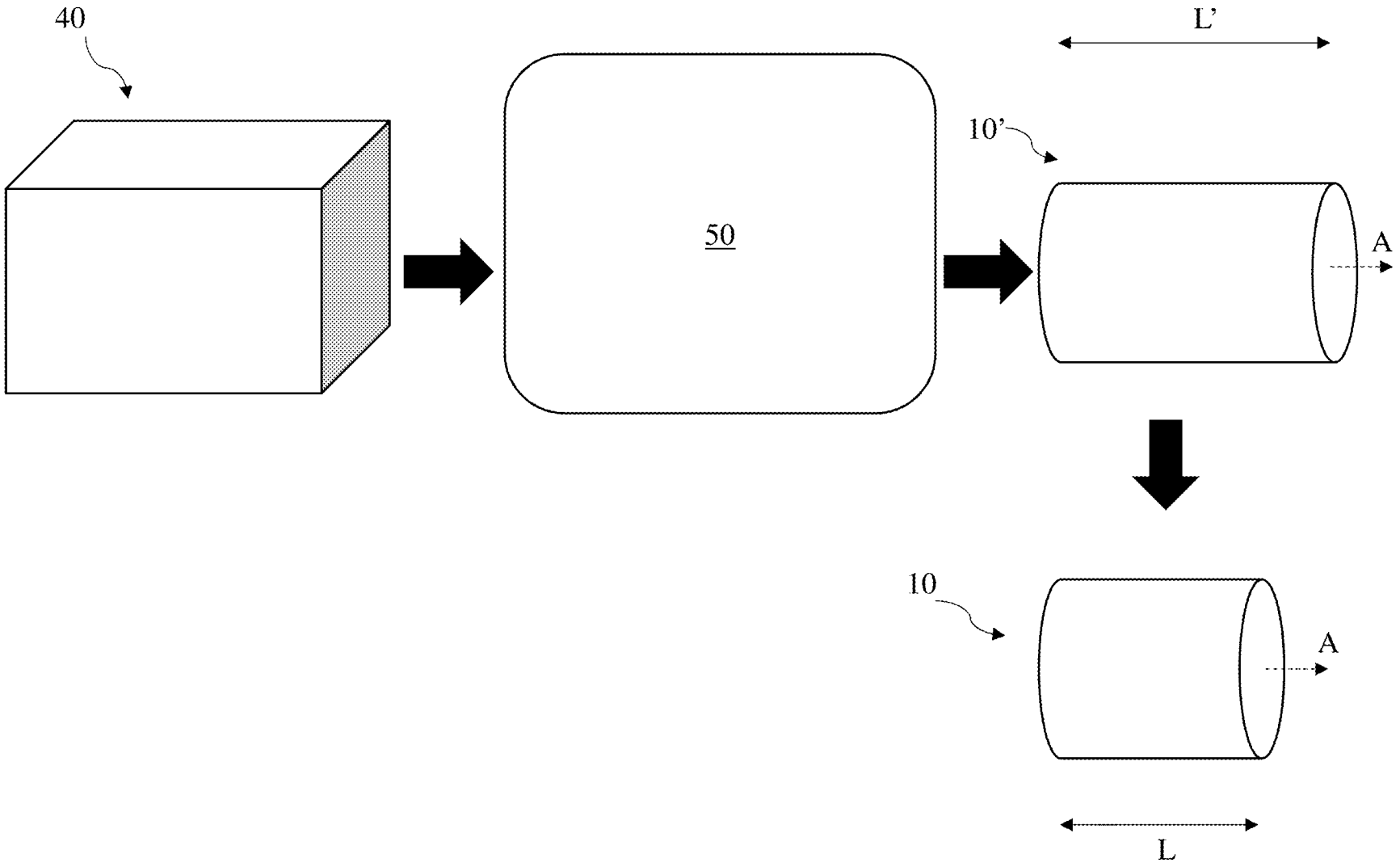
FIG. 2 shows a process flow for forming the hollow cylinder of FIG. 1 according to various implementations.

In some optional implementations, hollow cylinder 10 can be formed by an extrusion process, such as a hot extrusion process. FIG. 2 shows a schematic process flow diagram illustrating one example process used to form hollow cylinder 10 from a precursor structure 40. In various implementations, precursor structure 40 can include a block of material or other structure of the material (e.g., metal, plastic, composite). As in conventional extrusion processes, precursor structure 40 can be forced (e.g., pressed) through an extrusion apparatus 50 in order to form a hollow cylinder (e.g., an elongated version of hollow cylinder 10). In some cases, extrusion apparatus 50 includes a die or other mold shaped to form the hollow cylinder, e.g., including a negative of the hollow cylinder shape. In some implementations, the precursor structure 40 is heated prior to being forced through extrusion apparatus 50, in what is conventionally referred to as a hot extrusion press procedure. However, the hollow cylinder can be extruded according to any conventional approach. In some cases, from extrusion, a hollow cylinder 10' is formed at a length (L') that is greater than desired for particular subsequent processes or applications. In these optional implementations, as shown in FIG. 2, the hollow cylinder 10' can be cut or otherwise machined to a predetermined length (L) after being extruded. In some implementations, the hollow cylinder 10' can be cut using a laser cutting machine or a computer numerical cutting (CNC) machine. In some cases, cutting hollow cylinder 10' to the predetermined length (L) includes cutting the hollow cylinder 10' at an angle approximately perpendicular to the primary axis (A), such that ends of the hollow cylinder 10 are substantially parallel (e.g., within the margin of error of a measurement apparatus).

As shown in FIG. 2, after cutting, hollow cylinder 10 is formed at predetermined length (L). In some implementations, the predetermined length (L) can be dictated by a desired size of a later-formed product, such as a loudspeaker housing. While the preliminary extrusion and/or cutting processes shown and described with reference to FIG. 2 can be performed according to some implementations, it is understood that these processes are optional in various implementations. That is, in various implementations, processes can be performed on a hollow cylinder 10 formed by other methods and/or provided for forming a loudspeaker housing as described herein. For example, in some implementations, hollow cylinder 10 can be extruded or otherwise formed at length (L) such that cutting or other machining is not necessary.

Figure 3:
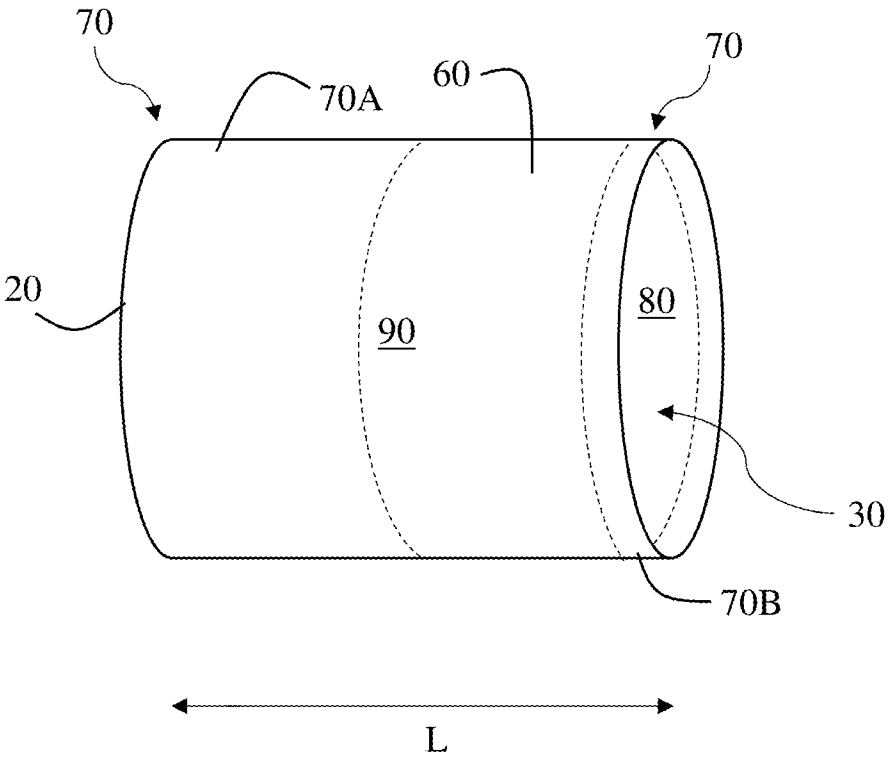
FIG. 3 shows a perspective view of the hollow cylinder of FIG. 1 undergoing processes according to various implementations.
Figure 4:
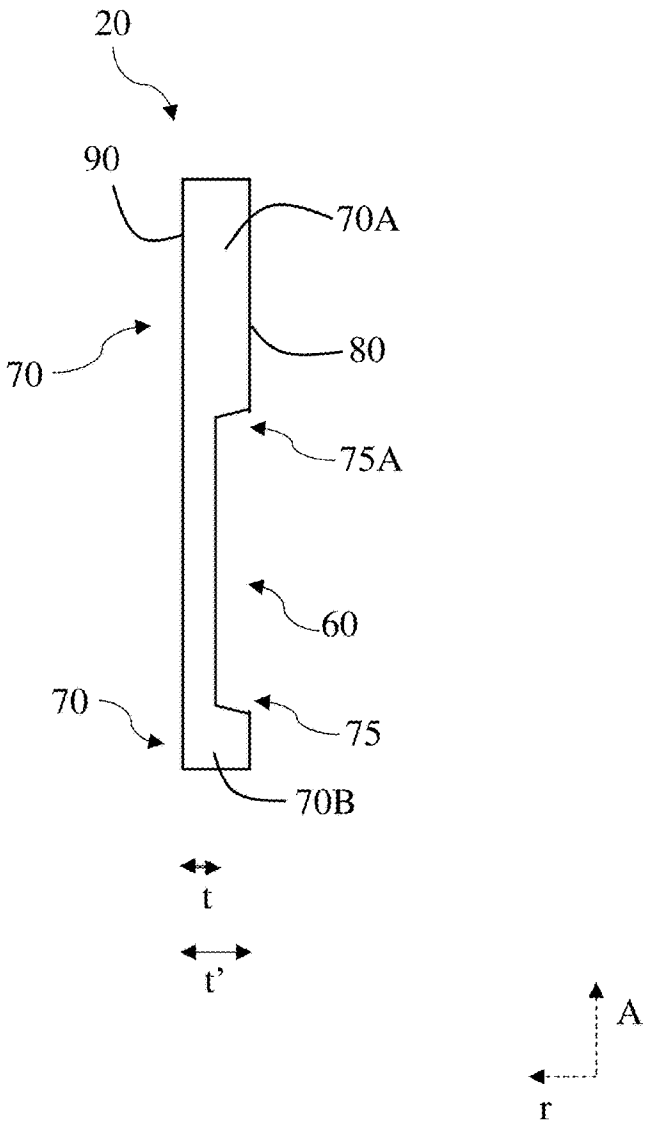
FIG. 4 shows a partial cross-sectional view of the hollow cylinder of FIG. 3.

In additional optional implementations, the hollow cylinder 10 can undergo further pre-processing, as shown in FIGS. 3-4. In these cases, the thickness (t') of wall 20 can be reduced in a first region 60 of the wall 20 (shown in the cross-sectional view along axis (A) of FIG. 4). That is, the wall 20 can be machined to form the first region 60 with a lesser thickness (t) than a second (distinct) region 70 of the wall 20 (FIG. 4). In various particular cases, the first region 60 can be machined to span a portion of the length (L) of the hollow cylinder 10 (FIG. 3). According to some implementations, the first region 60 can span approximately 30 percent to approximately 50 percent of the length (L) of the hollow cylinder 10 (FIG. 3). However, the first region 60 can also span up to an entirety or nearly an entirety of the length (L) of hollow cylinder 10 in some other implementations (e.g., such that nearly an entirety of the length (L) of hollow cylinder is thinned). In particular cases, the second region 70 can be left non-machined, at thickness (t'). According to some implementations, second region 70 can include two distinct sub-regions 70A and 70B, which may be located on opposite ends of first region 60 along the length (L) of the hollow cylinder 10. In some cases, as discussed further herein, sub-region 70B can form an internal lip 75 along the inner surface of wall 20. In some cases, the lip 75 can be formed including a chamfered edge or beveled edge, however, in other implementations, the lip 75 can be formed including a straight edge. In some cases, an additional lip 75A is formed in sub-region 70A, which may have a similar shape as lip 75, or may have a distinct shape (e.g., rounded corner, chamfered/beveled edge or straight edge). In various implementations, wall 20 can be machined by grinding, laser ablation, sanding, CNC machining, etc.

As described further herein, and shown more clearly in the partial cross-sectional view of wall 20 in FIG. 4, wall 20 has an inner surface 80 and an outer surface 90. According to various implementations, only the inner surface 80 of wall 20 is machined, providing a uniform profile along the (non-machined) outer surface 90 of wall 20. In particular implementations, first region 60 can be machined (e.g., thinned) such that thickness (t) is approximately 30 to approximately 60 percent of the thickness (t') of second region 70, as measured in the radial direction (r). In some particular cases, the thickness (t) of first region 60 is between approximately 0.5 millimeters (mm) and approximately 1.5 mm, and in more particular cases, is equal to approximately one (1) millimeter (+/−0.1 mm). In some cases, the thickness (t') of the second region 70 is between approximately 2.5 mm and 3.5 mm, and in more particular cases, is equal to approximately 3.2 mm (+/−0.2 mm).

Figure 5:
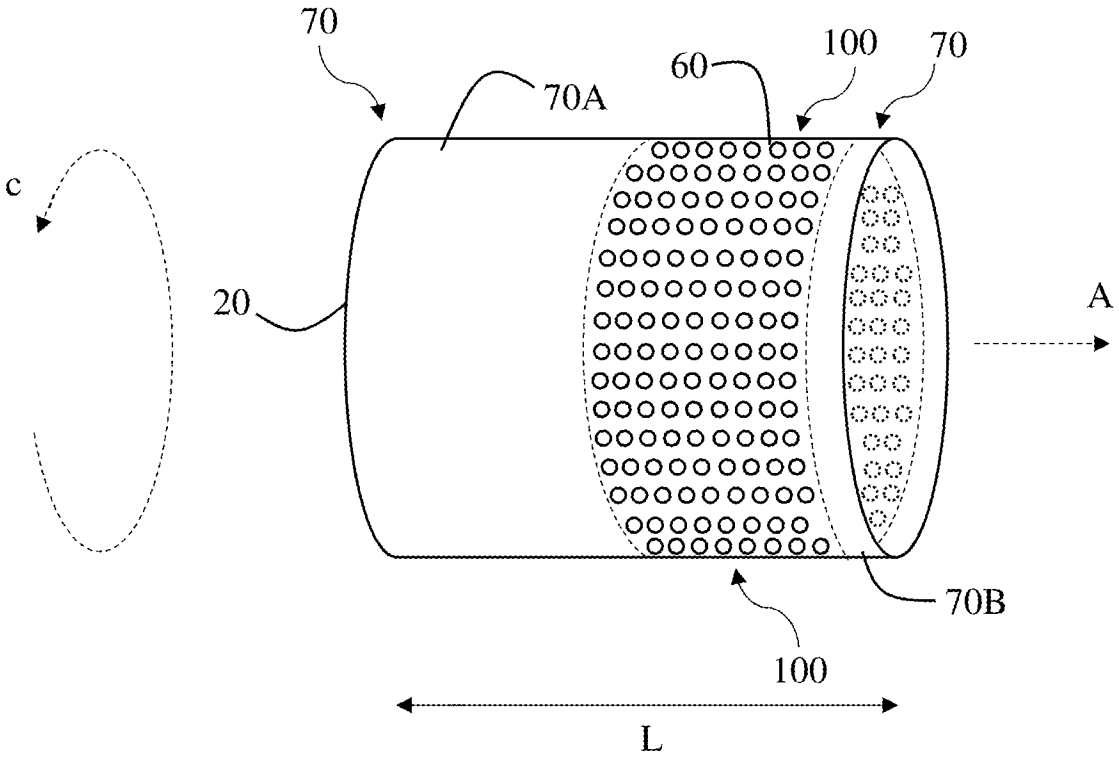
FIG. 5 shows a perspective view of the hollow cylinder of FIG. 3 undergoing processes according to various implementations.
Figure 6:
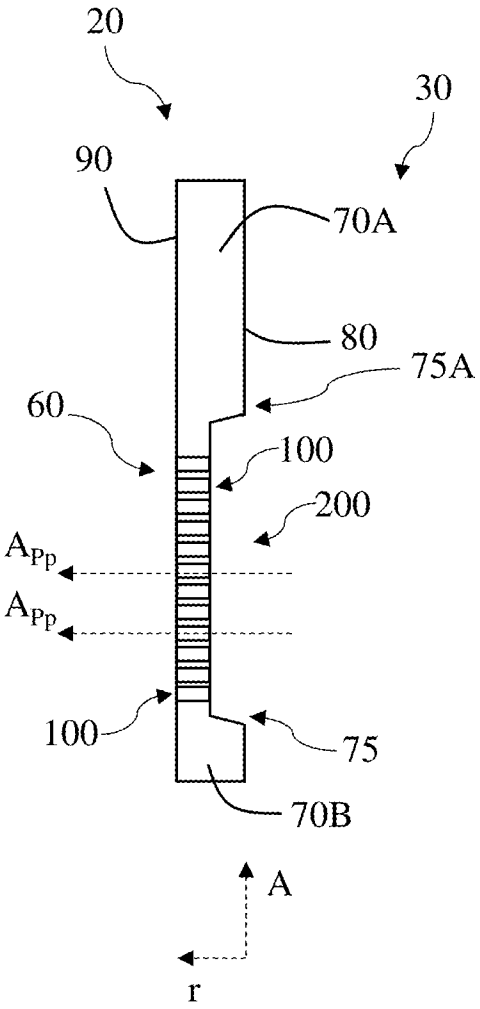
FIG. 6 shows a partial cross-sectional view of the hollow cylinder of FIG. 5.

FIG. 5 illustrates a process performed on a hollow cylinder, such as hollow cylinder 10, which can include forming a set of perforations 100 along the first region 60 of the wall 20. FIG. 6 illustrates perforations 100 extending through first region 60 in the radial direction (r), from the cross-sectional perspective of FIG. 4. In some cases, as noted herein, the first region 60 of hollow cylinder 10 can include a reduced thickness (e.g., machined) section of the wall 20, which may be machined prior to forming perforations 100. However, it is understood that in other optional implementations, the first region 60 can be thinned (e.g., machined) subsequent to forming perforations 100.

In various particular implementations, perforations 100 can be formed through wall 20 of hollow cylinder 10 using a drilling apparatus, stamping apparatus, punching apparatus or cutting members. In some cases, each of the set of perforations 100 extends entirely through the first region 60 of the wall 20, e.g., in the radial direction (r). Perforations 100 can include holes that extend through wall 20 at an angle normal to the corresponding surfaces of the wall 20 through which they pass.

In particular implementations, a drilling apparatus is used to form perforations 100 in wall 20 of the hollow cylinder 10. The drilling apparatus can include a high-speed drilling apparatus, a CNC drilling/cutting apparatus and/or a laser cutting apparatus. In these cases, the drilling apparatus can include one or more drilling members (e.g., one or more rows of several drilling members) for forming perforations 100 in the wall 20. In some implementations, the drilling apparatus can be programmed or otherwise controlled to form perforations 100 in the wall 20 according to a prescribed pattern (e.g., including spacing between adjacent perforations 100 and/or rows of perforations 100).

In other cases, a stamping apparatus is used to form perforations 100 in wall 20 of the hollow cylinder 10. The stamping apparatus can include a stamping plate with a pattern for stamping perforations 100 in the wall 20. The stamping plate can be electro-mechanically controlled (e.g., via a control system such as a computer-implemented control system) to stamp the wall 20 of hollow cylinder 10 according to a prescribed pattern (e.g., including spacing between adjacent perforations 100 and/or rows of perforations 100).

In other implementations, one or more cutting members can be used to form perforations 100 in the wall 20 of hollow cylinder 10. These cutting members can include any conventional mechanical or laser-based cutting machines for forming perforations in a material such as wall 20. In some implementations, the cutting machine is controllable (e.g., programmable) to form perforations 100 in the wall 20 of hollow cylinder 10 according to a prescribed pattern (e.g., including spacing between adjacent perforations 100 and/or rows of perforations 100).

In some other cases, an index punching apparatus is used to form perforations 100 in wall 20 of hollow cylinder 10. According to particular implementations, the index punching apparatus can include a plurality of punching members (e.g., one or more rows of several punching members, such as metal or hard synthetic spikes or protrusions) for forming perforations 100 in the wall 20. The index punching apparatus can include a core section and one or more punching members arranged along an outer surface of the core section. In these cases, the index punching apparatus can form perforations 100 using an inside-out approach on wall 20 (e.g., where punching apparatus is located within inner area 30). However, it is understood that an index punching apparatus can also be used to form perforations 100 from an outside-in approach on wall 20. In these cases, the index punching apparatus can include one or more rows (e.g., for aligning along axial direction (A)) of punching members arranged along a base for punching perforations 100 through wall 20.

In some cases, such as in the inside-out approach, the drilling apparatus, stamping apparatus, cutting members and/or index punching apparatus can include an arcuate core segment (e.g., at least a portion of a circular segment) with corresponding members (e.g., drilling member(s), stamping member(s), cutting member(s) and/or punching member(s)) at normal angles along the surface of the arcuate core segment. In these implementations, a plurality of columns of members in distinct circumferential positions (relative to axis (A)) can form corresponding perforations extending around at least a portion of the circumference of wall 20. In other cases, the drilling apparatus, stamping apparatus, cutting members and/or index punching apparatus can include a linear arrangement of members for forming perforations 100 along a single axial row (parallel with axis (A)) in wall 20. According to various embodiments, perforations 100 can be formed across a portion of, or an entirety of, the circumference of the hollow cylinder 10, e.g., at the first section 60. FIG. 5 illustrates optional implementations (in phantom) where perforations 100 completely wrap around first section 60. However, it is understood that perforations 100 can be formed along any portion of the circumference of hollow cylinder 10. In some example implementations, the perforations have a pitch of approximately 2 mm to approximately 2.5 mm (with particular example implementations having an approximate pitch of 2.25 mm), and a diameter of approximately one (1) mm to approximately 2 mm (with particular example implementations having a diameter of approximately 1.5 mm). According to various particular implementations, perforations 100 are approximately uniform in radius and pitch (e.g., within the margin of error of a corresponding measurement system), and extend entirely through the wall 20 of hollow cylinder 10.

In any case, the circular shape of hollow cylinder 10 permits the drilling apparatus, stamping apparatus, cutting members and/or punching apparatus to form perforations that have a primary axis ($A_{P_p}$) approximately perpendicular to each of the outer surface 90 and the inner surface 80 around each perforation 100. That is, as shown in FIG. 6, according to various implementations, the primary axis ($A_{P_p}$) of each perforation 100 deviates by less than approximately 3 degrees from perpendicular between the inner surface 80 and the outer surface 90. In this sense, each perforation 100 is formed at an approximately normal angle relative to the portion of the wall 20 through which it extends.

Figure 7:
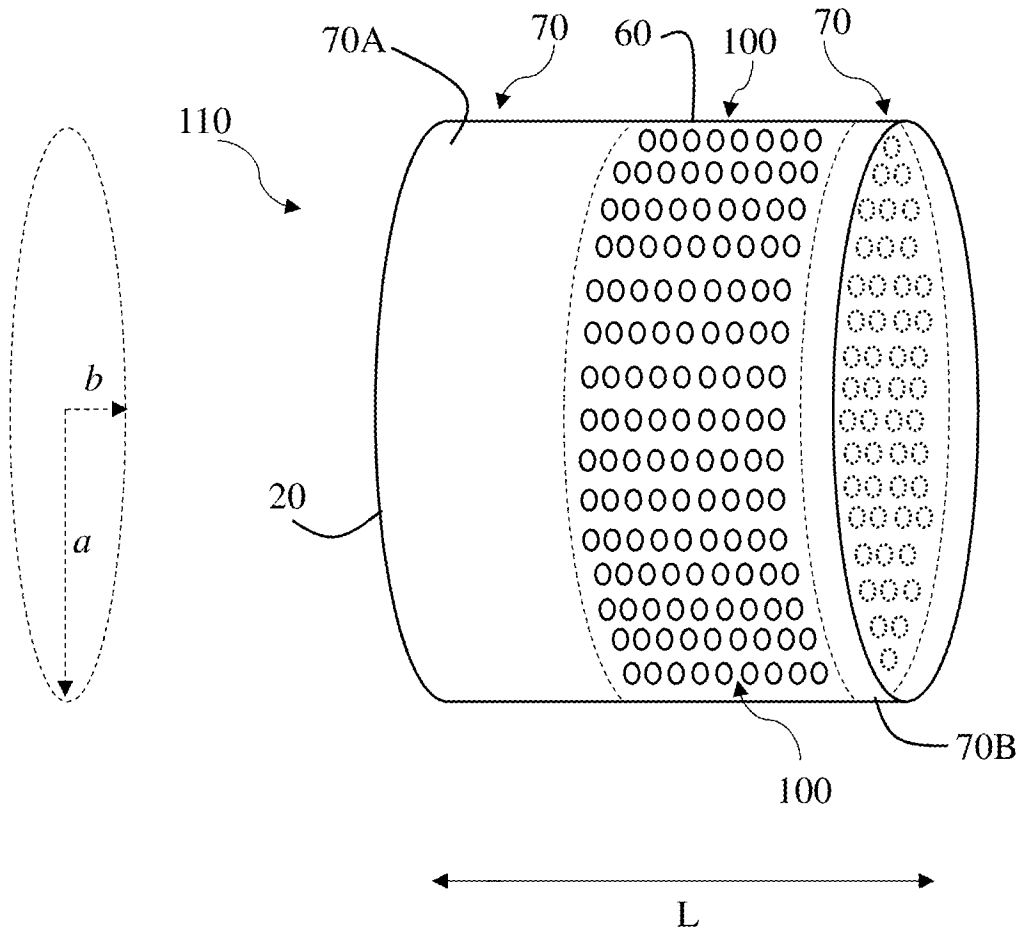
FIG. 7 shows a perspective view of a speaker housing after undergoing processes according to particular implementations.

According to various implementations, after forming perforations 100 in wall 20, a process can include deforming the wall 20 to a non-circular shape. In this sense, a non-circular speaker housing is formed, including the plurality of perforations 100 at approximately normal angles relative to their corresponding portions of the wall 20. FIG. 7 illustrates the (non-circular) speaker housing 110 according to various implementations. As noted herein, according to various implementations, the wall 20 of speaker housing 110 can have a non-circular cross-sectional shape. That is, a cross-section of wall 20 taken at an angle normal to the primary axis (A) (FIG. 5) will have a non-circular shape. In some cases, speaker housing 110 can be deformed to an ellipsoidal cylindrical shape, such that the speaker housing is formed as a cylinder with an elliptical cross section. The elliptical cross section can have a major half-axis (a) and a distinct minor half-axis (b), intersecting each other at a ninety-degree angle. In some other cases, the process of deforming the wall 20 to the non-circular shape can include extruding the precursor structure 40 (FIG. 2) in the desired non-circular shape (e.g., ellipsoidal cross-sectional shape) and subsequently forming the perforations 100 in smaller groupings (e.g., row-by-row) in order to achieve the desired normal angle of those perforations 100 through wall 20. However, it is understood that according to various implementations, speaker housing 110 can be deformed to any non-circular shape, such that a normal cross-section of the speaker housing 110 does not include a common radius extending around the entire circumference of that shape.

Figure 8:
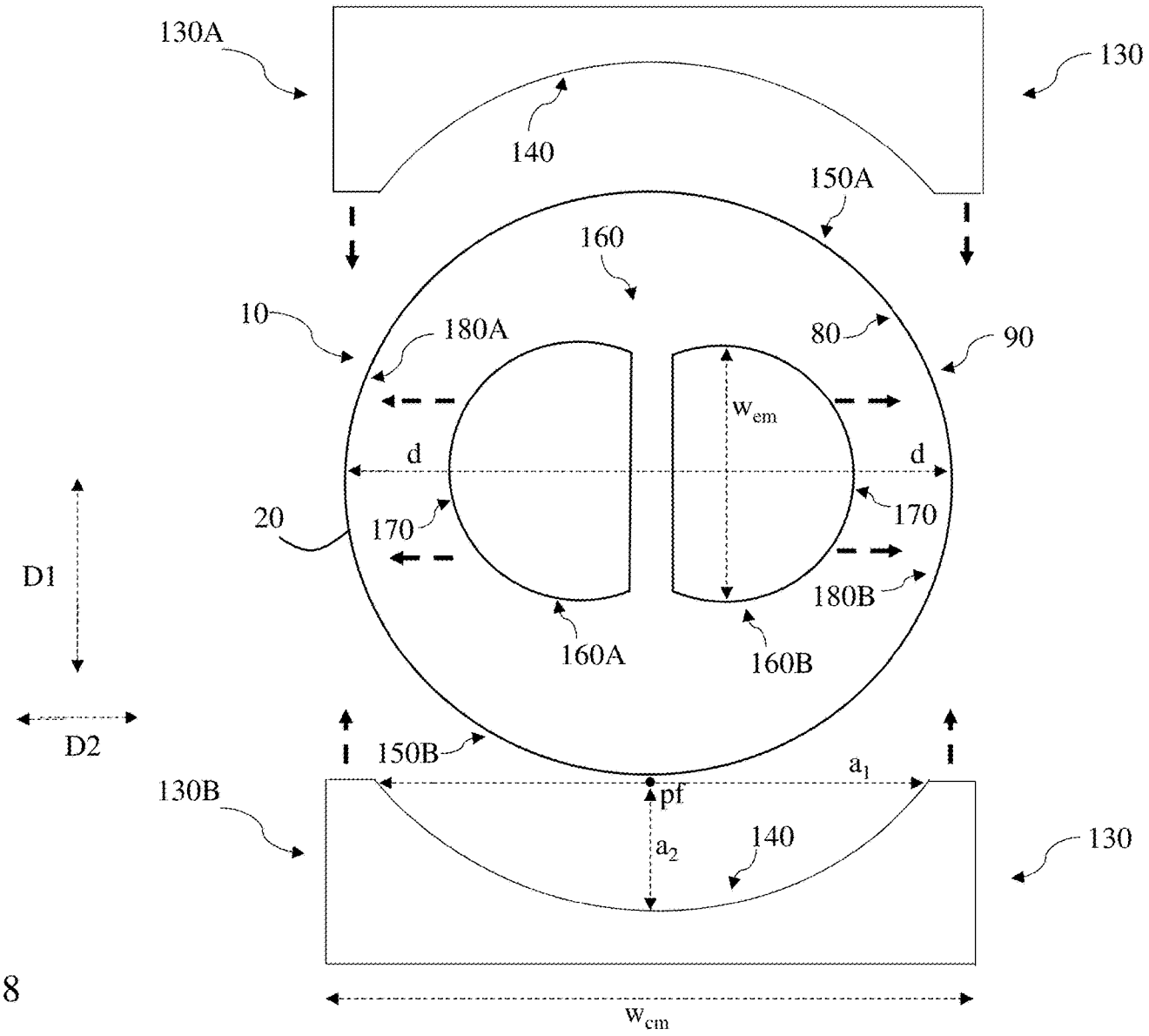
FIG. 8 shows an end view of a tool for performing processes on the hollow cylinder of FIG. 5 to form the speaker housing of FIG. 7, according to particular implementations.

In some particular implementations, the speaker housing 110 can be formed using a tool 120, as shown in the example depiction of FIG. 8. Tool 120 is shown including a set of compression members 130 sized to accommodate the hollow cylinder 10, where each compression member 130A, 130B (two shown in this example) has an elongated arcuate (e.g., concave) interface 140 for contacting distinct portions 150A, 150B of the outer surface 90 of wall 20. In various implementations, compression members 130 can include one or more plates or blocks shaped to interact with the portions 150A, 150B of the outer surface 90 of wall 20. In some cases, compression members 130 can include a metal such as steel (e.g., cold rolled steel). In various implementations, compression members 130 can each include an elongated arcuate interface 140 that is sized to accommodate a corresponding portion (e.g., portion 150A, 150B) of the hollow cylinder 10. In particular implementations, each elongated arcuate interface 140 has an ellipsoidal arcuate shape such that two distinct axes ($a_1$, $a_2$) intersect a common focal point (pf) at 90-degree angles (illustrated with respect to compression member 130B). In some cases, each compression member 130A, 130B has a width ($w_{cm}$) that is greater than the diameter (d) of hollow cylinder 10 (e.g., greater than both inner diameter and outer diameter). According to the particular example shown in FIG. 8, two compression members 130A, 130B are aligned opposed to one another relative to the hollow cylinder 10 in order to form the speaker housing 110 (FIG. 7). However, it is understood that any number of compression members 130 could be used to provide compression to the portions 150A, 150B of hollow cylinder 10. It is further understood that compression members 130 can be coupled to one another to provide symmetrical compression to the hollow cylinder 10, or that compression members 130 may be independently controlled to provide compression to hollow cylinder 10.

Tool 120 can additionally include a set of elongation members 160 sized to fit inside the hollow cylinder 10, where each elongation member 160A, 160B (two shown in this example) has an arcuate (e.g., convex) interface 170 for contacting distinct portions 180A, 180B of the inner surface 80 of wall 20. In various implementations, elongation members 160 can include one or more plates or blocks shaped to interact with the portions 180A, 180B of the inner surface 80 of wall 20. In some cases, elongation members 160 can include a metal such as steel (e.g., cold rolled steel). In particular implementations, elongation members 160 can include expandable members such as one or more expandable bladders for providing elongation force on the wall 20. In some implementations, elongation members 160 can each include arcuate interface 170 (e.g., having an arc radius of approximately 30 degrees to approximately 70 degrees) that is sized to contact corresponding portions (e.g., portion 180A, 180B) of the hollow cylinder 10. In some cases, each arcuate interface 170 has an arc radius that is approximately equal to or less than the arc radius of hollow cylinder 10. In various particular implementations, the elongated arcuate interface 140 of each compression member 130A, 130B is non-complementary with respect to the arcuate interface 170 of each respective elongation members 160A, 160B. In various implementations, each elongation member 160 has a width ($w_{em}$) that is less than the diameter (d) of hollow cylinder 10. According to the particular example shown in FIG. 8, two elongation members 160A, 160B are aligned adjacent one another inside hollow cylinder 10 in order to form the speaker housing 110 (FIG. 7). However, it is understood that any number of elongation members 160 can be used to provide elongation force to the portions 180A, 180B of hollow cylinder 10. It is further understood that elongation members 160 can be coupled to one another to provide symmetrical elongation force to the hollow cylinder 10, or that elongation members 160 may be independently controlled to provide elongation force to hollow cylinder 10.

During operation of tool 120, the set of compression members 130 and the set of elongation members 160 are configured to compress the hollow cylinder 10 in a first dimension (D1) and elongate the hollow cylinder 10 in a second direction (D2) to form speaker housing 110 (FIG. 7). In various implementations, the first dimension (D1) and the second dimension (D2) are substantially perpendicular with respect to one another. In some cases, the compression members 130 and elongation members 160 work in concert to simultaneously (or nearly simultaneously) apply force to hollow cylinder 10 in order to elongate that hollow cylinder 10 and form speaker housing 110. That is, in various implementations, the speaker housing 110 is formed by moving the compression members 130 toward one another to compress the hollow cylinder 10 in the first dimension (D1) while substantially simultaneously moving the elongation members 160 away from one another to elongate the hollow cylinder 10 in the second dimension (D2). According to some implementations, hollow cylinder 10 can be subjected to heating or other techniques to enhance the pliability of the wall 20 before, during or after the deformation process. For example, hollow cylinder 10 may be pre-heated for enhancing the effectiveness of the deformation process, and may be subsequently cooled to solidify the modified shape of the hollow cylinder as a speaker housing 110.

Figure 9:
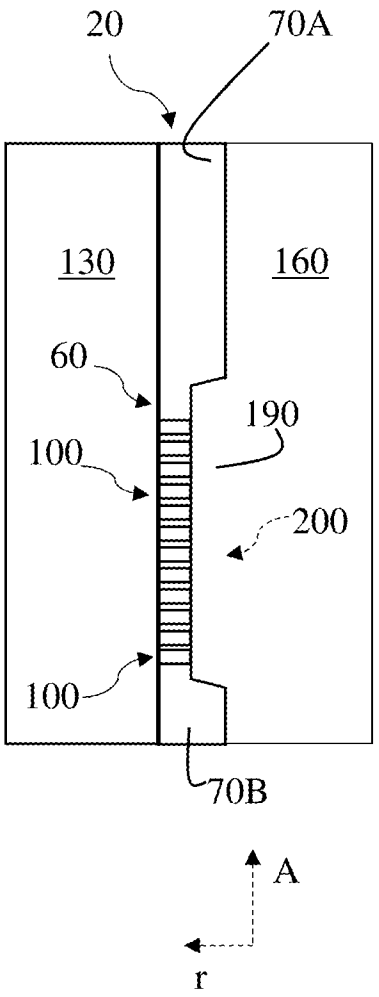
FIG. 9 shows a partial cross-sectional view of the hollow cylinder and tool of FIG. 8 according to various additional implementations.

Tool 120 can be sized to mate with one or more features of hollow cylinder 10. As shown in the cross-sectional view of FIG. 9, in some particular implementations, the elongation member(s) 160 can include a mating feature 190 that is sized to complement a recess 200 in the first section 60 of the wall 20. Mating feature 190 can include a protrusion or tab that is sized to complement (e.g., completely fill or nearly completely fill) the recess 200 in first section 60 of the wall 20. In this sense, the mating feature 190 can be positioned to apply elongation force across the entirety of wall 20 at the portions 180A, 180B (FIG. 8).

Figure 10:
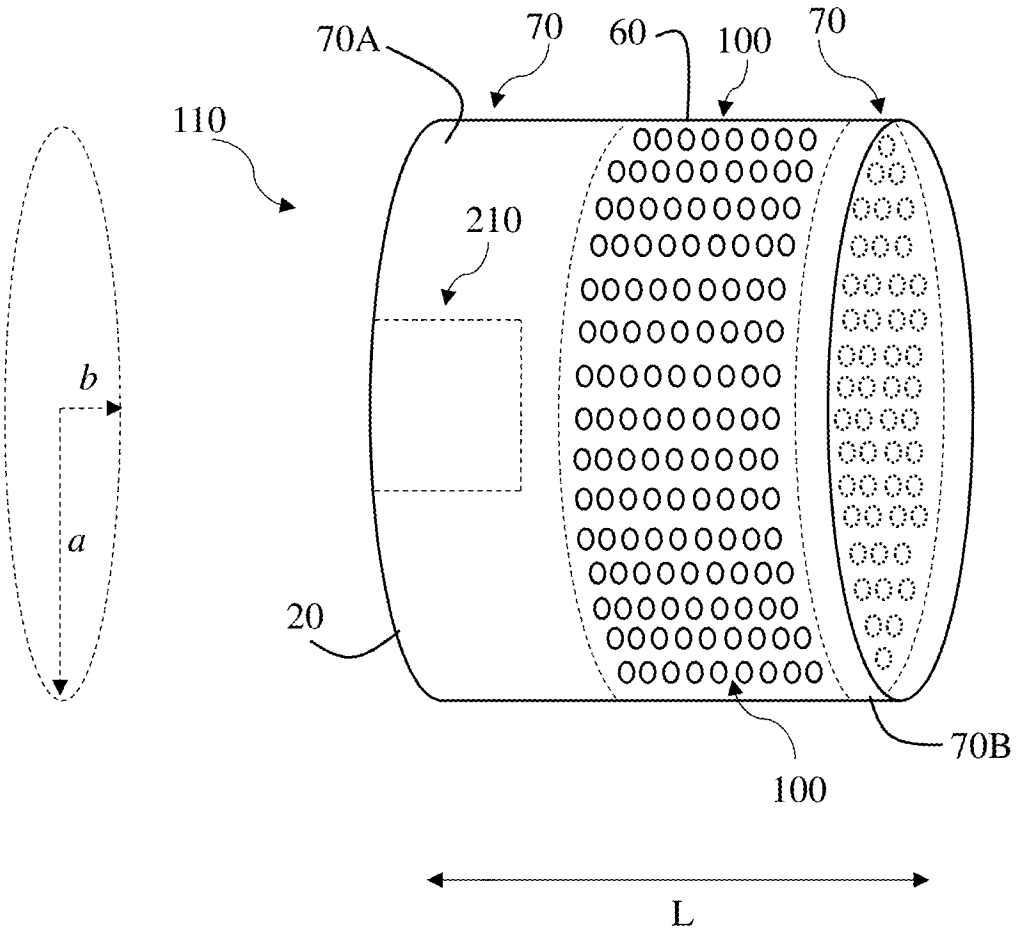
FIG. 10 shows a perspective view of an example speaker housing according to various additional implementations.

FIG. 10 illustrates additional optional implementations including further processes of forming an interface slot 210 in wall 20, as well as blasting and/or anodizing wall 20 after hollow cylinder 10 has been deformed to speaker housing 110. In these implementations, the interface slot 210 can be cut (e.g., via laser cutting or other conventional cutting techniques described herein and/or known in the art) through wall 20 in order to provide an interface (e.g. user interface such as a capacitive touch interface) for interacting with the speaker. Interface slot 210 can take any shape capable of accommodating an interface for the speaker. Additionally, implementations can include blasting the surfaces of wall 20 with an abrasive material e.g., an abrasive medium (such as silica sand or metal pellets) having medium to mild abrasiveness in order to smooth any surface roughness and finish those surfaces. Following blasting, where wall 20 is formed of a metal, the surfaces of wall 20 can be anodized according to conventional approaches. As is known in the art, in the case of metal components, anodizing includes applying electrolytic passivation to surfaces in order to increase the thickness of the oxide on those metal surfaces. Anodizing may be particularly beneficial in implementations where wall 20 is formed of aluminum or an alloy of aluminum.

As shown in FIG. 10 and elsewhere herein, in some cases, perforations 100 in the speaker housing 110 can collectively form a grille for surrounding a speaker component, e.g., electronic and/or acoustic components of a speaker system. That is, the perforations 100 can permit location of a driver for outputting sound through a speaker system contained within speaker housing 110. As noted herein, perforations 100 can be formed at angles that are normal to the surfaces of the wall 20 through which they pass. The various implementations described herein allow for efficient formation of these perforations 100 to achieve a uniform grille. That is, alternatives to the approaches described herein may have shortcomings. For example, if perforations 100 were to be formed after elongating the hollow cylinder 10, it would be significantly more difficult to form those perforations 100 at normal angles relative to the wall 20 of the hollow cylinder 10. In these cases, a row-by-row approach for forming perforations may be possible, but the time and expense corresponding with that approach would be significant relative to the disclosed implementations herein. Additionally, a specialty tool (e.g., drilling apparatus, stamping apparatus, cutting members and/or punching apparatus) could be developed with an elongated arcuate interface to achieve the result of implementations herein, but that approach would likely be expensive and have limited applications when compared with the disclosed implementations herein. The approaches disclosed according to various implementations can effectively form a non-circular speaker housing with a set of perforations at normal angles relative to the wall through which they extend. In some cases, the normal angles of the perforations can provide for enhanced transparency relative to housings where such perforations are at angles other than approximately normal. For example, perforations that are not normal to the surface of the wall through which they extend may produce a distinct appearance than the speaker housing 110 having (approximately) normal angles relative to the surface of the wall 20. That is, the speaker housing 110 shown and described according to various implementations can have a more transparent appearance than a speaker housing formed with perforations that are not normal to the surface(s) of the wall.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A method of forming a speaker housing, the method comprising:

forming a set of perforations along a first region of a wall of a hollow cylinder of material, wherein the wall surrounds a primary axis of the hollow cylinder, and wherein the hollow cylinder comprises a circular cylinder having an approximately identical radius at all points along a circumference measured from a corresponding location along the primary axis; and deforming the wall to a non-circular shape after forming the set of perforations, wherein the deformed wall forms a portion of the speaker housing, and wherein the set of perforations define a grille for the speaker housing.

2. The method of claim 1, further comprising, prior to forming the set of perforations along the first region of the wall:

extruding the hollow cylinder of material from a precursor structure; and cutting the hollow cylinder of material to a predetermined length.

3. The method of claim 2, wherein cutting to the predetermined length comprises cutting the hollow cylinder of material at an angle approximately perpendicular to the primary axis.

4. The method of claim 2, wherein extruding the hollow cylinder of material from the precursor structure is performed using a hot extrusion press.

5. The method of claim 1, further comprising reducing a thickness of the wall in the first region of the hollow cylinder, wherein the set of perforations is formed in the region of reduced thickness.

6. The method of claim 1, further comprising blasting and anodizing the wall after deforming the wall to the non-circular shape.

7. The method of claim 1, wherein each of the set of perforations extends entirely through the first region of the wall, wherein the first region of the wall has an inner surface and an outer surface opposing the inner surface, and wherein the set of perforations each have a primary axis approximately perpendicular to each of the outer surface and the inner surface around each perforation at the first region of the wall, and wherein the primary axis of each perforation deviates by less than approximately 3 degrees from perpendicular between the inner surface and the outer surface.

8. The method of claim 1, wherein the perforations extend around at least a portion of a circumference of the wall along the first region.

9. The method of claim 8, wherein the perforations extend around an entirety of the circumference of the wall along the first region, and wherein deforming the wall comprises deforming an entirety of the wall.

10. The method of claim 1, wherein the hollow cylinder of material is seamless about a primary axis thereof.

11. The method of claim 1, wherein deforming the wall to the non-circular shape includes deforming the wall to an ellipsoidal cylindrical shape having a major half-axis and a distinct minor half-axis, wherein the major half-axis and the minor half-axis intersect each other at a ninety degree angle.

12. The method of claim 1, wherein the hollow cylinder of material includes a metal.

13. A method of forming a speaker housing, the method comprising:

forming a set of perforations along a first region of a wall of a hollow cylinder of material, wherein the wall surrounds a primary axis of the hollow cylinder, wherein the hollow cylinder comprises a circular cylinder having an approximately identical radius at all points along a circumference measured from a corresponding location along the primary axis, wherein each of the perforations extends entirely through the first region of the wall and is formed at an approximately normal angle relative to a portion of the wall through which each of the perforations extends; and deforming the wall to a non-circular shape after forming the set of perforations wherein the deformed wall forms a portion of the speaker housing, and wherein the set of perforations define a grille for the speaker housing.

14. The method of claim 13, wherein the perforations extend around an entirety of the circumference of the wall along the first region, wherein the first region of the wall has an inner surface and an outer surface opposing the inner surface, wherein the set of perforations each have a primary axis approximately perpendicular to each of the outer surface and the inner surface around each perforation at the first region of the wall, and wherein deforming the wall comprises deforming an entirety of the wall.

15. The method of claim 14, wherein each of the perforations is approximately uniform in radius and pitch, and wherein the non-circular shape comprises an ellipsoidal cylindrical shape.

* * * * *